US006176292B1

(12) United States Patent
Norton, II

(10) Patent No.: US 6,176,292 B1
(45) Date of Patent: Jan. 23, 2001

(54) DOOR WITH AUTOMATIC MISALIGNMENT ACCOMMODATING FINGER GUARD

(75) Inventor: George H. Norton, II, Higganum, CT (US)

(73) Assignee: The Stanley Works, New Britain, CT (US)

( * ) Notice: Under 35 U.S.C. 154(b), the term of this patent shall be extended for 0 days.

(21) Appl. No.: 09/429,021

(22) Filed: Oct. 29, 1999

Related U.S. Application Data

(60) Provisional application No. 60/137,517, filed on Jun. 2, 1999.

(51) Int. Cl.[7] ..... E05D 15/26
(52) U.S. Cl. ..... 160/206; 160/118
(58) Field of Search ..... 160/206, 199, 160/118, 40, 117, 213, 376; 49/383, 480.1

(56) References Cited

U.S. PATENT DOCUMENTS

| | | | | |
|---|---|---|---|---|
| 3,314,534 | * | 4/1967 | Winnan | 160/260 X |
| 4,133,365 | * | 1/1979 | Schleicher | 160/118 |
| 4,574,960 | * | 3/1986 | Weiss | 160/206 X |
| 5,214,880 | | 6/1993 | Woodruff et al. . | |
| 5,216,839 | | 6/1993 | Woodruff et al. . | |
| 5,816,309 | * | 10/1998 | Paradise | 160/199 X |

* cited by examiner

*Primary Examiner*—David M. Purol
(74) *Attorney, Agent, or Firm*—Pillsbury Madison & Sutro LLP

(57) ABSTRACT

A door assembly with an automatic misalignment accommodating finger guard comprising a door panel assembly having a panel member having an edge space and a door edge defining member including an inner portion configured to be positioned in an operative relation within the space by a relative longitudinal movement with respect to the panel member. A longitudinal position determining member is detachably fixed to the door edge defining member in a position to extend within a longitudinal position determining opening in the elongated panel member. A spring system is provided which acts between the door edge defining member and the panel member to resiliently bias the door edge defining member into a longitudinally determined limiting position. The door edge defining member and the spring system cooperate to enable the latter to be moved against the bias of the spring system angularly and/or translationally inwardly within the space in response to the engagement of the defined elongated door edge thereof with a closing surface during movement of the door panel assembly into the closed position to thereby automatically accommodate misalignment with the closing surface or with an object, such as a finger or the like, inadvertently disposed between the closing surface and the defined elongated door edge during movement of the door panel assembly into the closed position to thereby serve as a finger guard. The position determining member is configured and positioned to accommodate the angularly inward and/or translationally inward movement of the door edge defining member with respect to the panel member while maintaining the door panel assembly substantially in the determined longitudinal position thereof.

12 Claims, 3 Drawing Sheets

DOOR WITH AUTOMATIC MISALIGNMENT ACCOMMODATING FINGER GUARD

This application claims the benefit of U.S. Provisional Application No. 60/137,517, filed Jun. 2, 1999.

This invention relates to doors and more particularly to doors of the type having edge finger guard assemblies.

BACKGROUND OF THE INVENTION

It is quite common for many doors to be fitted along the closing edge thereof with a resilient finger guard. Typically, finger guards of this type consist of a rubber strip along the edge of the door which provides pinch protection only to the extent that the rubber will compress. Rubber will normally be absent from the lockset opening exposing this area as non-protected protected pinch point. The lockset area is also normally fixed in conventional doors requiring at least one piece of door edge material above the lock and another piece below the lock.

Rigid type finger guards are known. Basically, the rigid type guards which are available provide for adjustability by the use of screws or other fasteners which serve to limit the outer resilient movement of the rigid edge. The fit provided by manual adjustment is often a transient thing and readjustment oftentimes is just never made or presents difficulties which are troublesome. Moreover, the adjustment screws also present a non-protected pinch point.

BRIEF SUMMARY OF THE INVENTION

It is the object of the present invention to provide a door having a finger guard assembly which achieves the advantages of known finger guard assemblies while to a large extent eliminating the disadvantages thereof. In accordance with the principles of the present invention, this objective is achieved by providing a door assembly with an automatic misalignment accommodating finger guard assembly comprising a door panel constructed and arranged to be mounted in operative relation with respect to a door opening to be moved between opened and closed positions with respect to the door opening. The door panel assembly has an elongated panel member extending generally vertically when the door panel assembly is mounted in operative relation to the door opening. The panel member includes a pair of transversely spaced rigid wall sections having free edges formed with short flanges extending therefrom toward one another. The wall sections and flanges define a space in said member. A rigid door edge defining member constructed and arranged to automatically accommodate misalignment between the panel assembly and a closing surface. The door edge defining member includes an inner portion positioned in an operative relation within the space by a relative longitudinal movement with respect to the panel member and an outer portion extending outwardly of the space when the inner portion is in operative relation with the panel member. The inner portion has flange engaging surfaces. A longitudinal position determining member detachably fixed to the door edge defining member extends within a longitudinal position determining opening in the panel member. A spring system acting between the door edge defining member and the door edge structure resiliently biases the door edge defining member into a longitudinally determined limiting position wherein the flange engaging surfaces are disposed in engagement with the flanges and the outer portion of the door edge defining member extends outwardly of the flanges to define an elongated door edge spaced outwardly from the elongated panel edge structure. The door edge defining member and the spring system enable the inner portion thereof to be moved against the bias of the spring system angularly and/or translationally inwardly within the space in response to the engagement of the defined elongated door edge thereof with a closing surface during movement of the door panel assembly into the closed position to thereby automatically accommodate misalignment with the closing surface or with an object, such as a finger or the like, inadvertently disposed between the closing surface and the defined elongated door edge during movement of the door panel assembly into the closed position to thereby serve as a finger guard. The position determining member is configured and positioned with respect to the longitudinal position determining opening to accommodate the angularly inward and/or translationally inward movement of the door edge defining member with respect to the panel member while maintaining the door panel assembly substantially in the determined longitudinal position thereof.

DETAILED DESCRIPTION OF THE PREFERRED EMBODIMENT OF THE PRESENT INVENTION

Figure 2:
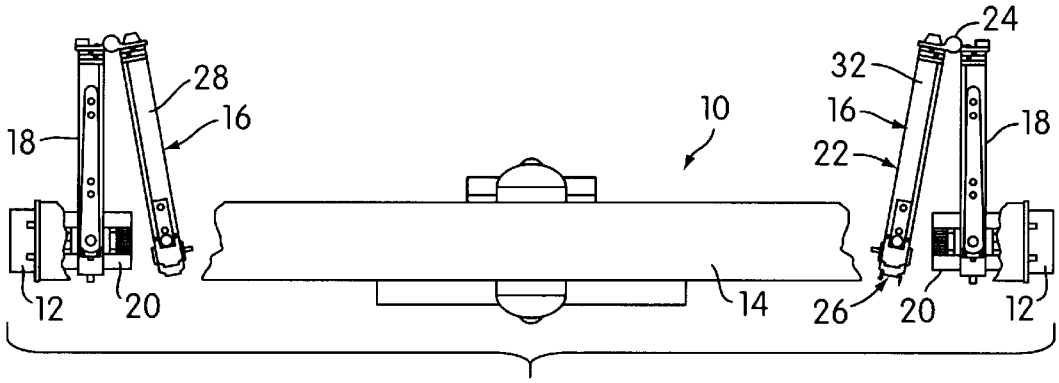
FIG. 2 is a top plan view of thereof with certain parts broken away for purposes of clear illustration.
Figure 1:
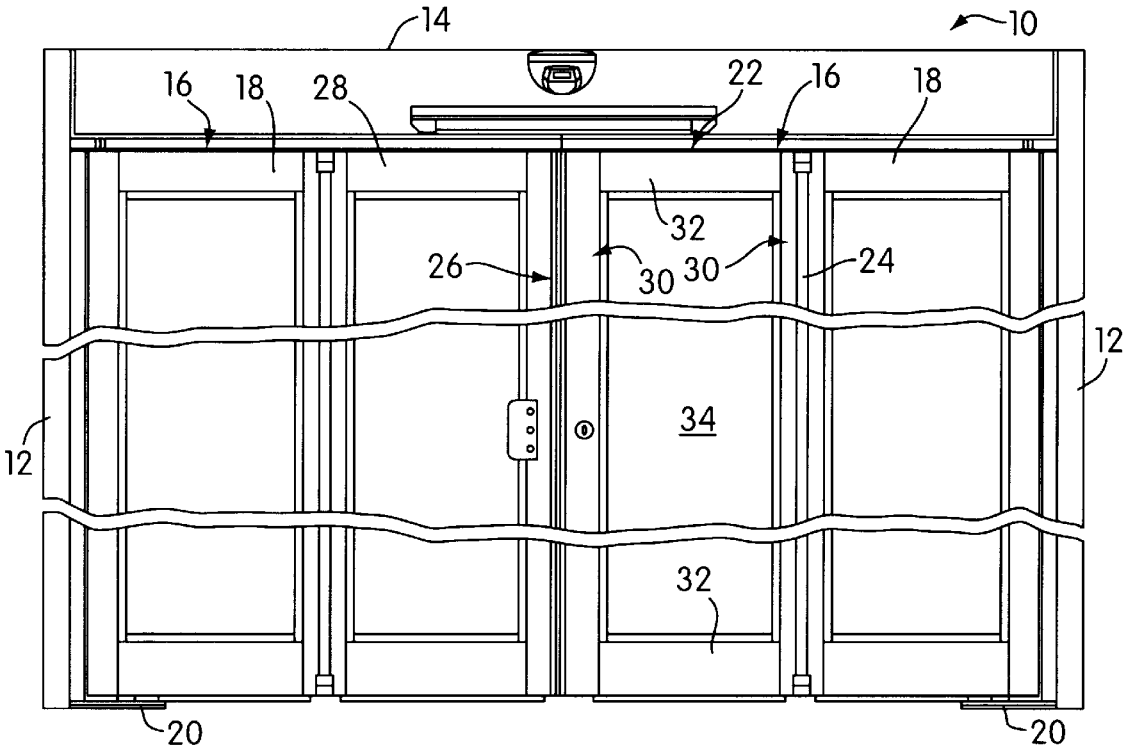
FIG. 1 is a front elevational view of a bi-folding door assembly embodying the principles of the present invention.
Figure 4:
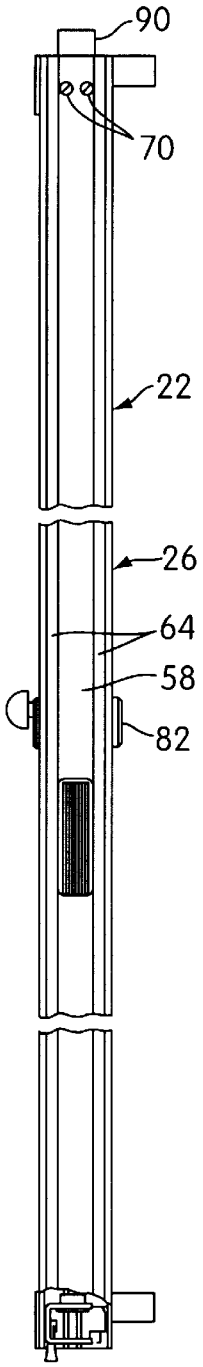
FIG. 4 is a side edge view of the door panel shown in FIG. 3.

Referring now more particularly to the drawings, there is shown in FIGS. 1 and 2 a bi-folding door assembly, generally indicated at 10, which embodies the principles of the present invention. As shown, the assembly 10 is adapted to fit within spaced vertical wall frame members and an overhead horizontal wall frame member as a unit. To this end, the assembly 10 includes a pair of horizontally spaced upright door jambs 12 having a track assembly 14 extending between the upper ends thereof. The door assembly itself includes two pairs of hingedly interconnected door panels 16. Each pair of door panels 16 includes an inner door panel assembly, generally indicated at 18, which is suitably pivoted at its upper and lower ends to the upper track assembly 14 and a foot plate 20 which is mounted on the floor. One pair of door panels 16 includes an outer panel assembly, generally indicated at 22, which is pivoted at one end by a pivot assembly 24 to the adjacent edge of the associated inner door panel assembly 18 and which is provided with an automatic misalignment accommodating finger guard assembly, generally indicated at 26, constructed in accordance with the principles of the present invention. The other pair of door panels 16 includes an outer door panel assembly 28 which is pivoted at one end to the adjacent edge of the associated inner door panel assembly 18 and which has a free edge provided with suitable weather stripping and with a cooperating closing surface for engagement with the finger guard assembly 26 when misaligned therewith.

In the embodiment shown, the finger guard assembly 26 is provided on only the outer panel assembly 22 but it will be understood that the finger guard assembly 26 could be embodied in the outer panel 28 as well. Moreover, the finger guard assembly 26 could be embodied in the hinged edge of the outer panel assembly 22 or 28 and in either edge of either inner panel assembly. Likewise, it will be understood that the finger guard assembly 26 constructed in accordance with the principles of the present invention has applicability to any door either swinging, sliding or as otherwise.

In the embodiment shown, the door panel assemblies 18, 22 and 28 are constructed of metal frame components, specifically frame components which are made up of extrusions of light metal, such as aluminum, aluminum alloys, magnesium, magnesium alloys and the like. As best shown in FIGS. 3–7, the outer panel assembly 32 includes spaced parallel vertically extending elongated door panel members, generally indicated at 30, interconnected at their upper and lower ends by upper and lower panel members 32. The panel members 30 and 32 serve to mount a central panel 34 which may be in the form of a mirror or clear glass or an opaque material, such as plastic, metal or wood. As shown, the vertical panel members 30 are interconnected with the upper and lower panel members 32 by suitable fastening elements 36 which are well known.

Figure 5:
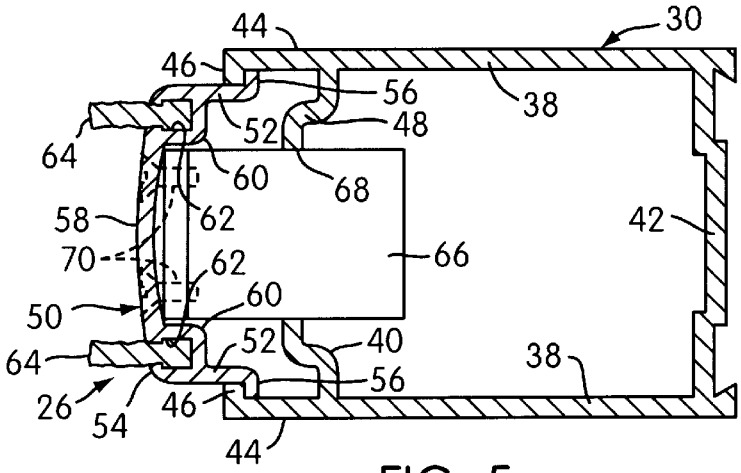
FIG. 5 is an enlarged fragmentary sectional view taken along the line 5—5 of FIG. 3.
Figure 6:
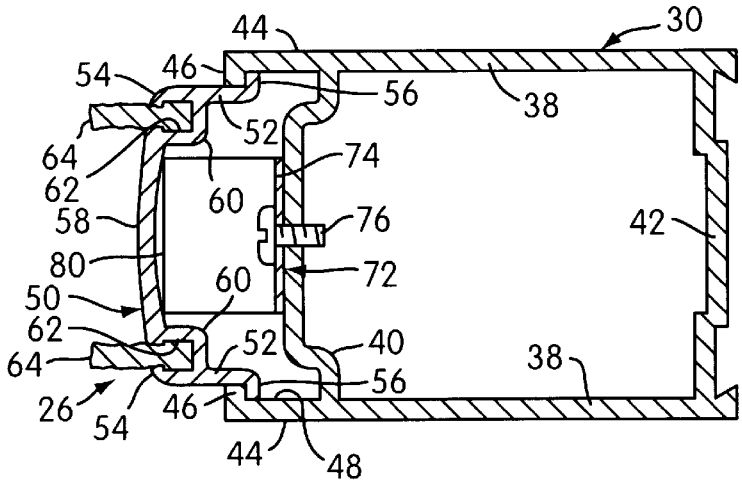
FIG. 6 is an enlarged fragmentary sectional view taken along the line 6—6 of FIG. 3.
Figure 7:
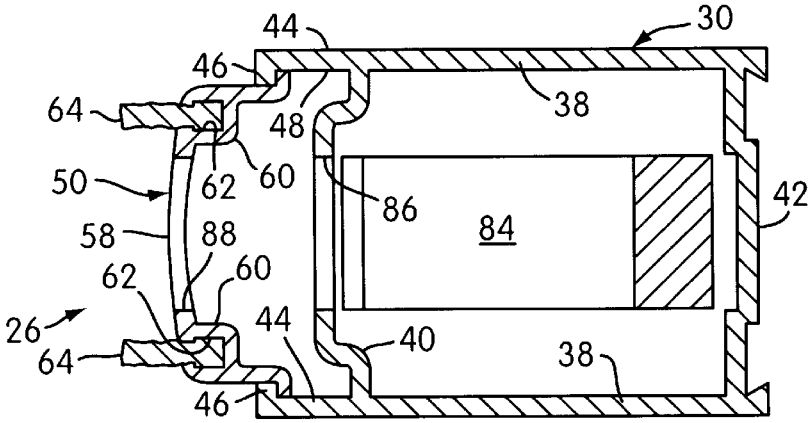
FIG. 7 is an enlarged fragmentary sectional view taken along the line 7—7 of FIG. 3.

As previously indicated, each panel member 30 is preferably an extrusion of a light metal. As best shown in FIGS. 5–7, the extrusion includes parallel panel end walls 38 being interconnected along one marginal edge by an integral cross wall 40 and having another integral cross wall 42 extending integrally from the opposite ends thereof in spaced relation so as to define marginal wall sections 44 which extend outwardly and have in-turned flanges 46 on the outer free ends thereof. The marginal end wall sections 44 and the flanges 46 define with the cross wall 40 a space 48 within which is mounted an elongated door edge defining member generally indicated at 50.

As best shown in FIGS. 5–7, the door edge defining member 50 is constructed and arranged so as to be slidably mounted longitudinally within the space 48 provided by the panel member 30. To this end, it will be noted that the door edge defining member 50 also is preferably formed as an extrusion of light metal in the manner previously indicated having opposed door edge end walls 52 each formed with an in-turned flange 54 at one end thereof and an out-turned flange door edge 56 at the opposite end thereof. The out-turned flanges 56 and the adjacent section of the end walls 52 constitute an inner portion of the door edge defining member 50 which is mounted within the space 48.

It will also be noted that the out-turned flanges 56 provide outwardly facing surfaces which may abuttingly engage inwardly facing surfaces of the in-turned flanges 46 provided by the panel member 30. The door edge defining member 50 also includes a front wall 58 which is transversely slightly convex in its configuration, Opposite marginal edges of the front wall 58 are interconnected with the adjacent end walls 52 by an L-shaped wall section 60 an end of one leg of which is integral with the central portion of the associated end wall 52 and an end of the opposite leg of which is integral with an associated marginal edge of the front wall 58. The L-shaped wall sections 60 define with the adjacent portion of the end walls 52 T-shaped slots 62 at each end of the front wall 58. The transversely spaced T-shaped slots are configured to slidably receive therein a pair of conventional rubber weather strips 64.

Figure 3:
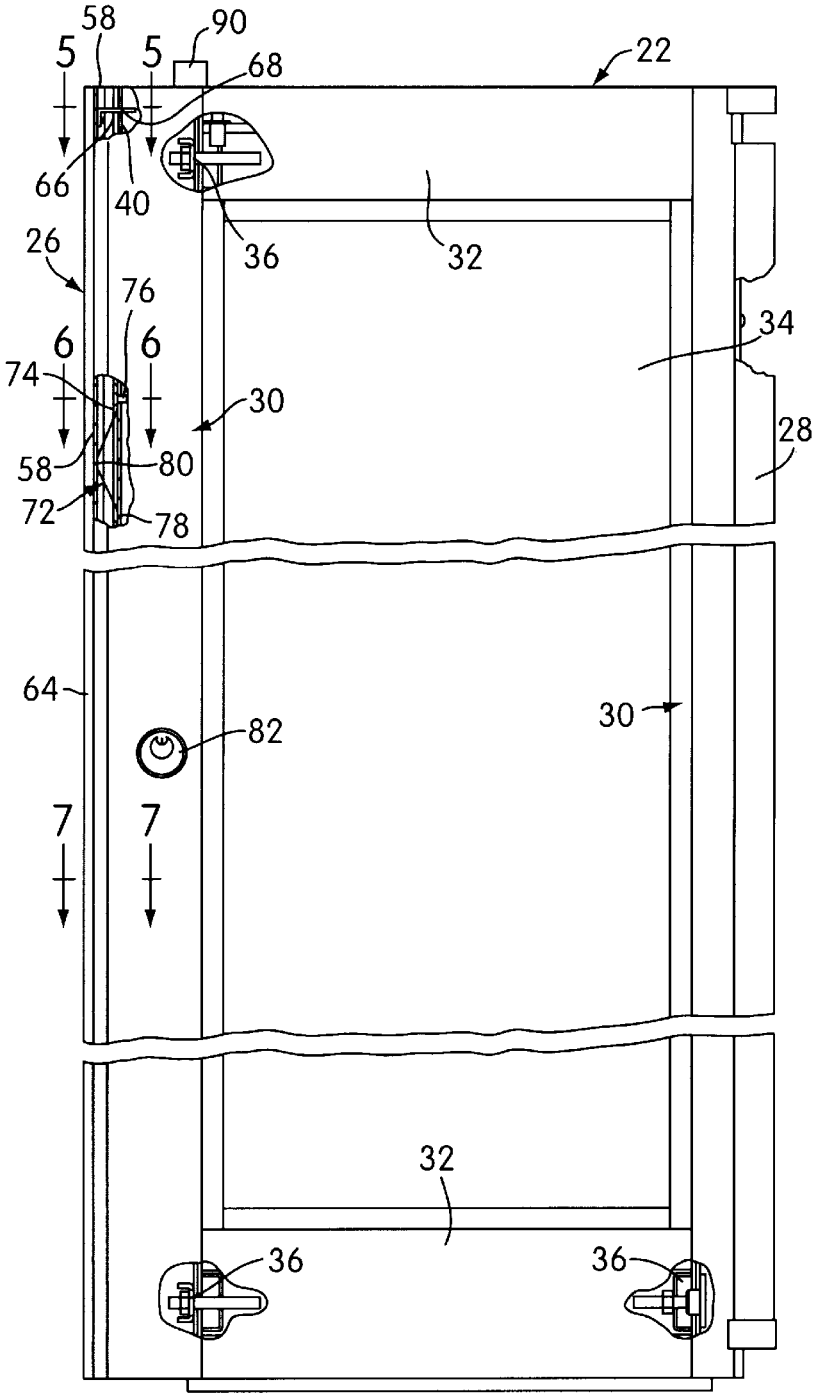
FIG. 3 is an enlarged front elevational view of the door panel which embodies the automatic misalignment accommodating edge construction embodying the principles of the present invention.

As best shown in FIGS. 3 and 5, there is provided a longitudinal position determining structure in the form of a L-shaped member 66 which is constructed and arranged to cooperate with a longitudinal position determining opening 68 formed in the panel member 30 to determine the longitudinal position of the door edge defining member 50 within the space 48. As shown, the L-shaped member 66 includes a vertical leg which is suitably detachably fixed to the inner surface of the front wall, as by threaded bolts 70, and a horizontal leg which extends through the longitudinal position determining opening 68 formed in the cross-wall 40 of the panel member 80. It will be noted that once the door edge defining member 50 is moved longitudinally within the space 48, the longitudinal position determining member 66 is then fixed to the front wall 58 by bolts 70 with the leg portion extending through the opening 68 so that it now determines the longitudinal position of the door edge defining member 50 with respect to the panel member 30. In the operative position of the door panel assembly 22, this longitudinal direction will be vertical. The engagement of the leg of the member 66 within the opening 68 is such as to permit angular and translational movements of the edge defining member 50 within the space 48.

Referring now more particularly to FIGS. 3 and 6, it will be noted that there is provided a spring system, generally indicated at 72, which acts between the panel member 30 and the door edge defining member 50 to resiliently urge the latter outwardly into a limiting position wherein the out-turned flanges 56 of the door edge defining member 50 are in engagement with the in-turned flanges 46 of the panel member 30. The spring system 72 as shown is in the form of a plurality of vertical spaced leaf springs, each including a mounting portion 74 which is adapted to engage the cross wall 40 of the panel member 30 so as to be secured thereto, as by a bolt 76 as shown in FIG. 6. Each leaf spring 72 is essentially in the form of a shallow V-shaped configuration with a free end 78 which is disposed in engagement with the cross wall 40 and a angular mid-portion 80 which is engaged with the front wall 58 of the door edge defining member 50. It can be seen that the leaf springs 72 are thus capable of biasing the door edge defining member 50 into its outer limiting position and to permit the door edge defining member 50 to be moved inwardly of the space either angularly or translationally or both.

Referring now more particularly to FIGS. 3 and 7, it will be noted that the outer door panel assembly is provided with a lock assembly 82 of conventional design which is suitably installed within the central portion of the panel member 30. The lock assembly 82 includes a hook-shaped lock member 84 which is normally disposed within the panel member 30 between the cross walls 40 and 42 when the lock assembly 82 is in a normal unlocked position. When the lock assembly 82 is actuated to move it into a locked position, the hook shaped member 84 pivots outwardly through an opening 86 formed in the cross wall 40 of the panel member 30 and a similar registering opening 88 formed in the front wall 58 of the door edge defining member 50. In this way, when the outer door panel assembly 22 which is guided by an upper track engaging guide 90 in the track assembly 14 from an opened position as shown in FIG. 2 to a closed position as shown in FIG. 1, the outer surface of the front wall portion 56 of the door edge defining member 50 may engage a closing surface which is in misalignment and, if this is the case, the entire door edge defining member 50 will be moved into a position to automatically accommodate the misalignment. In the panel embodiment shown in FIGS. 1 and 2, the closing surface will be provided by the adjacent end of the opposite outer panel assembly 28 which in this case is simply provided with a conventional edge with suitable weather strips. In the event that the power closing of the door assembly should occur when an object such as a finger or the like is between the closing surface and the outer portion of the door edge defining member the latter will simply yield inwardly against the bias of the springs and guard the finger from damage.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A door assembly with an automatic misalignment accommodating finger guard comprising a door panel assembly constructed and arranged to be mounted in operative relation with respect to a door opening to be moved between opened and closed positions with respect to the door opening, said door panel assembly having an elongated panel member extending generally vertically when said door panel assembly is mounted in said operative relation, said panel member including a pair of transversely spaced rigid wall sections having free edges formed with short flanges extending therefrom toward one another, said wall sections and flanges defining a space in said panel member, a rigid door edge defining member constructed and arranged to automatically accommodate misalignment between said panel assembly and a closing surface, said door edge defining member including an inner portion configured to be positioned in an operative relation within said space by a relative longitudinal movement with respect to said panel member and an outer portion configured to extend outwardly of said space when said inner portion is in operative relation with said panel member, said inner portion having flange engaging surfaces, a longitudinal position determining member detachably fixed to said door edge defining member in a position to extend within a longitudinal position determining opening in said elongated panel member, and a spring system acting between said door edge defining member and said panel member constructed and arranged to resiliently bias said door edge defining member into a longitudinally determined limiting position wherein said flange engaging surfaces are disposed in engagement with said flanges and the outer portion of said door edge defining member extends outwardly of said flanges to define an elongated door edge spaced outwardly from said panel member, said door edge defining member and said spring system cooperating to enable the inner portion thereof to be moved against the bias of said spring system angularly and/or translationally inwardly within said space in response to the engagement of the defined elongated door edge thereof with a closing surface during movement of the door panel assembly into said closed position to thereby automatically accommodate misalignment with the closing surface or with an object, such as a finger or the like, inadvertently disposed between the closing surface and the defined elongated door edge during movement of the door panel assembly into said closed position to thereby serve as a finger guard, said position determining member being configured and positioned with respect to said longitudinal position determining opening to accommodate the angularly inward and/or translationally inward movement of the door edge defining member with respect to said panel member while maintaining the door panel assembly substantially in the determined longitudinal position thereof.

2. A door assembly as defined in claim 1 wherein said outer portion is formed with an opening configured to allow a door locking element to extend therethrough when said door panel assembly is in said closed position.

3. A door assembly as defined in claim 1 wherein said outer portion is formed with a pair of transversely spaced longitudinally extending tee slots and a pair of elongated weather stripping elements are mounted in said tee slots.

4. A door assembly as defined in claim 3 wherein said outer portion includes a slightly transversely convexly curved outer wall extending between said tee slots.

5. A door assembly as defined in claim 4 wherein said outer panel is formed with an opening configured to allow a door locking element to extend therethrough when said door panel assembly is in said closed position.

6. A door assembly as defined in claim 5 wherein said panel member is in the form of an extrusion of lightweight metal including parallel panel end wall having marginal portions defining said spaced rigid wall sections and spaced cross walls integrally interconnecting said panel end walls beyond the marginal portions thereof.

7. A door assembly as defined in claim 6 wherein said door edge defining member is in the form of an extrusion of lightweight metal including parallel door edge end walls, each having an in-turned flange along one edge and an out-turned flange along an opposite edge, said out-turned flanges defining said flange engaging surfaces, the extrusion forming said door edge defining member further including a L-shaped section integrally connected between each door edge end wall between the flanges thereof and an adjacent marginal edge of said front wall.

8. A door assembly as defined in claim 7 wherein said door panel assembly comprises an outer door panel assembly of a two panel hinged door assembly which includes a second door panel assembly hinged at one edge to an edge of said first mentioned door panel assembly opposite from the elongated door edge defined by said door edge defining member.

9. A door assembly as defined in claim 1 wherein said panel member is in the form of an extrusion of lightweight metal including parallel panel end walls having marginal portions defining said spaced rigid wall sections and spaced cross walls integrally interconnecting said panel end walls beyond the marginal portions thereof.

10. A door assembly as defined in claim 1 wherein said door edge defining member is in the form of an extrusion of lightweight metal including parallel door edge end walls, each having an in-turned flange along one edge and an out-turned flange along an opposite edge, said out-turned flange providing thereon said flange engaging surfaces, the extrusion forming said door edge defining member further including a pair of L-shaped sections each having an end of one leg thereof integrally connected with an associated door edge end wall between the flanges thereof and a front wall having a pair of transversely spaced marginal edge portions each being integrally connected with an end of an opposite leg of an associated L-shaped section.

11. A door assembly as defined in claim 1 wherein said door panel assembly comprises an outer door panel assembly of a two panel hinged door assembly which includes a second door panel assembly hinged at one edge to an edge of said outer door panel assembly opposite from the elongated door edge thereof defined by said door edge defining member.

12. A door assembly as defined in claim 1 wherein said panel member and said door edge defining member are formed of a metal containing aluminum.

* * * * *